US008966667B2

(12) United States Patent
Peck et al.

(10) Patent No.: US 8,966,667 B2
(45) Date of Patent: Mar. 3, 2015

(54) OUTER GARMENT WITH SUSPENSION SYSTEM FOR ATTACHING AN INNER GARMENT

(75) Inventors: Raphael Joseph Peck, Irvine, CA (US); Lawrance Quigley, Dana Point, CA (US)

(73) Assignee: Oakley, Inc., Foothill Ranch, CA (US)

( * ) Notice: Subject to any disclaimer, the term of this patent is extended or adjusted under 35 U.S.C. 154(b) by 0 days.

(21) Appl. No.: 13/247,625

(22) Filed: Sep. 28, 2011

(65) Prior Publication Data

US 2012/0117714 A1 May 17, 2012

Related U.S. Application Data

(60) Provisional application No. 61/497,452, filed on Jun. 15, 2011, provisional application No. 61/414,825, filed on Nov. 17, 2010.

(51) Int. Cl.

| | |
|---|---|
| ***A41D 1/06*** | (2006.01) |
| ***A41D 13/02*** | (2006.01) |
| ***A41D 13/00*** | (2006.01) |
| ***A41D 1/08*** | (2006.01) |

(52) U.S. Cl.

CPC ..... *A41D 13/0015* (2013.01); *A41D 1/08* (2013.01)

USPC ..... 2/227

(58) Field of Classification Search

USPC ..... 2/79, 227, 228, 69

See application file for complete search history.

(56) References Cited

U.S. PATENT DOCUMENTS

| | | | | |
|---|---|---|---|---|
| 443,390 | A * | 12/1890 | Caen | 2/70 |
| 711,666 | A * | 10/1902 | Loewenbach | 2/230 |
| 1,271,248 | A * | 7/1918 | Walcoff | 2/227 |
| 1,490,470 | A * | 4/1924 | Laubach | 2/227 |
| 1,797,115 | A | 3/1931 | Atkinson | |
| 2,034,312 | A * | 3/1936 | Rubin | 2/228 |
| 2,446,326 | A | 8/1948 | Guthues | |
| 2,599,769 | A * | 6/1952 | Macrae et al. | 2/228 |
| 3,357,076 | A | 12/1967 | Greenwald et al. | |
| 3,771,172 | A | 11/1973 | Barg | |
| 4,282,608 | A * | 8/1981 | Amberg | 2/227 |
| 4,325,148 | A * | 4/1982 | Livernois | 2/465 |
| 4,633,527 | A * | 1/1987 | Ehring | 2/22 |
| 4,956,878 | A | 9/1990 | Boynton | |
| RE33,406 | E | 10/1990 | Wior | |
| 5,598,586 | A | 2/1997 | Munjone | |
| 5,649,913 | A | 7/1997 | Cohen | |
| 5,987,721 | A | 11/1999 | Morris | |
| 6,108,823 | A * | 8/2000 | Danes | 2/403 |
| 6,308,338 | B1 | 10/2001 | Caldwell | |
| 6,317,893 | B1 * | 11/2001 | Walton | 2/227 |
| 6,665,882 | B1 * | 12/2003 | Pedrick | 2/228 |
| 6,789,270 | B1 * | 9/2004 | Pedrick | 2/228 |
| 6,804,832 | B2 * | 10/2004 | Beland | 2/227 |
| 7,124,448 | B2 * | 10/2006 | Davenport | 2/229 |

(Continued)

*Primary Examiner* — Amber Anderson

(74) *Attorney, Agent, or Firm* — Knobbe Martens Olson & Bear LLP

(57) ABSTRACT

A compound garment is provided, such as athletic shorts having an inner and outer short. The shorts can comprise a suspension system to interconnect the inner short and the outer short. The suspension system can allow the outer short to move relative to the inner short in any of or any combination of circumferential, radial, horizontal and/or vertical directions. The suspension system can provide a bias between the inner short and the outer short to a resting or neutral position, and the inner short may be a compression short.

25 Claims, 10 Drawing Sheets

(56) References Cited

U.S. PATENT DOCUMENTS

| | | | | |
|---|---|---|---|---|
| 7,686,796 | B2 | 3/2010 | Kuen et al. | |
| 7,849,518 | B2 | 12/2010 | Moore et al. | |
| 8,074,298 | B2 * | 12/2011 | Davenport | 2/227 |
| 8,214,922 | B2 | 7/2012 | Moore et al. | |
| 2004/0098784 | A1 | 5/2004 | Desai | |
| 2005/0071905 | A1 | 4/2005 | Polak et al. | |
| 2005/0165200 | A1 | 7/2005 | Selle et al. | |
| 2007/0000012 | A1 | 1/2007 | Davenport | |
| 2007/0101475 | A1 * | 5/2007 | Skottheim | 2/69 |
| 2008/0034476 | A1 | 2/2008 | MacKinnon | |
| 2008/0256676 | A1 | 10/2008 | Di Lorenzo | |
| 2008/0263742 | A1 | 10/2008 | Vaughn | |
| 2009/0064388 | A1 | 3/2009 | Baiany | |
| 2010/0043123 | A1 | 2/2010 | Goodhand et al. | |

* cited by examiner

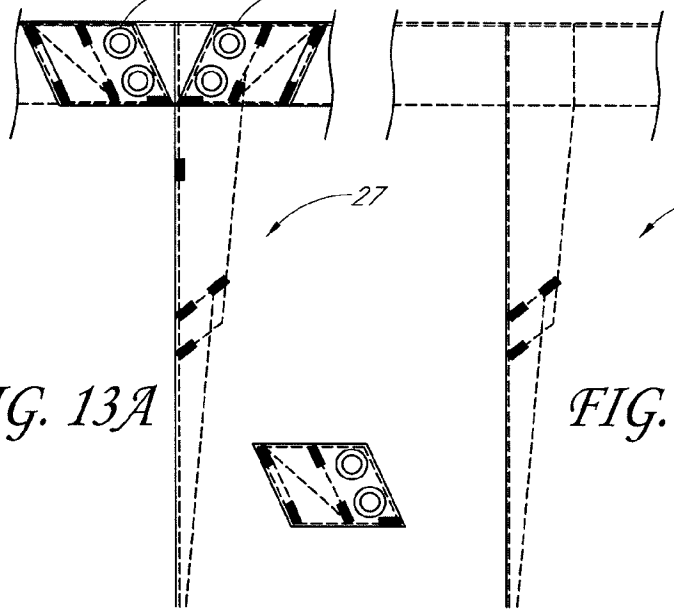
FIG. 13A
FIG. 13B
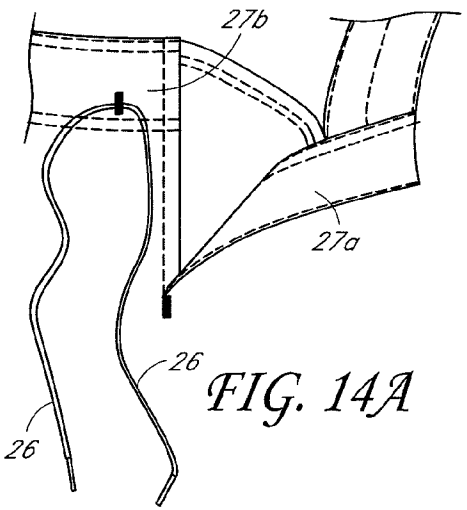
FIG. 14A
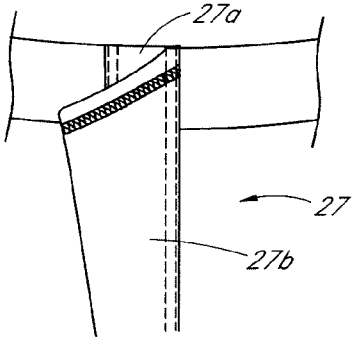
FIG. 14B

OUTER GARMENT WITH SUSPENSION SYSTEM FOR ATTACHING AN INNER GARMENT

RELATED APPLICATIONS

This application claims the benefit of U.S. Provisional Application No. 61/414,825, filed on Nov. 17, 2010, and U.S. Provisional Application No. 61/497,452, filed on Jun. 24, 2011, both titled "Compound Garment," the entire contents of which are hereby incorporated by reference and made a part of this specification.

BACKGROUND

1. Field of the Inventions

The present inventions relate to athletic shorts. More specifically, the present inventions relate to a pair of athletic shorts with a suspension system to suspend an outer short over an inner short.

2. Description of the Related Art

Some athletic apparel, including pants or shorts, has been fabricated using an inner garment that is attached to an outer garment. The inner garment generally fits snugly against the wearer while the outer garment is supported by the inner garment. These designs endeavor to improve comfort, flexibility, and durability of the garment during use.

SUMMARY

At least some of the embodiments disclosed herein reflect the realization that wearable garments, in particular, athletic shorts, can provide superior physiological utility and comfort by incorporating an inner support garment with an outer garment. One or more components or portions of such garments can be constructed from materials selected for their elongation and strength properties, to provide additional performance and comfort. For example, the inner garment can comprise a tensional or elastic material that fits closely against the wearer. In some embodiments, the inner garment can comprise a compression garment, which can provide support, comfort, protection, and enhanced wearer performance. The outer garment can be coupled with the inner garment using a suspension means or system. A stretchable material can be selected for the inner garment and/or outer garment and implemented in combination with the suspension system to provide a number of different levels of comfort, support, protection, and performance.

In some embodiments, the outer garment can comprise a short having a waist portion that forms a waist opening. The body of the short can extend downwardly from the waist portion to a crotch portion. Further, the outer garment can comprise a pair of leg portions extending downwardly from the crotch portion along an inseam. Each leg portion can form a leg opening. The inner short can be configured to closely conform to a wearer's body. The inner short can be configured to fit within and be worn in combination with the outer short.

Further, the suspension system can be configured to attach the inner short to the outer short and to suspend the outer short from the inner short. The suspension system can comprise at least one suspension element configured to couple the outer and inner shorts in a manner that allows the outer short and the inner short to move relative to each other in one or more of a circumferential, radial, axial, horizontal and/or vertical direction. In some embodiments, the suspension system can comprise two or more suspension elements.

In some embodiments, the suspension system can be coupled to waistbands of the outer and inner shorts. The suspension system can comprise at least one strap comprising a pair of opposing ends. Each opposing end of the strap can be attached to a portion of the inner short or the outer short to form a loop. Further, the suspension system can also comprise a first attachment mechanism that is attached or coupled with the other of the inner short or the outer short. Accordingly, the first attachment mechanism can be configured to attach the other of the inner short or the outer short to a corresponding second attachment mechanism configured on a portion of the strap. Thus, the suspension system can allow the outer short and the inner short to move relative to each other in one or more of a circumferential, radial, axial, horizontal and/or vertical direction.

BRIEF DESCRIPTION OF THE DRAWINGS

Various features of illustrative embodiments of the inventions are described below with reference to the drawings. The illustrated embodiments are intended to illustrate, but not to limit, the inventions. In particular, the written text in the drawings, with the exception of the reference numerals, is for exemplary purposes only, and is not intended to limit the drawings in any way, including the terms used or the dimensions shown. The drawings contain the following figures:

FIGS. 13A and 13B show front views of a fly portion of an athletic short, according to some embodiments.

FIG. 14A shows a close-up front view of the fly portion of FIGS. 13A-13B, with the fly shown in an open position.

FIG. 14B shows a close-up rear view of an embodiment of the fly portion of FIG. 14A, in a closed position.

DETAILED DESCRIPTION

While the present description sets forth specific details of various embodiments, it will be appreciated that the description is illustrative only and should not be construed in any way as limiting. Additionally, it is contemplated that although particular embodiments of the present inventions may be disclosed or shown in the context of board shorts or athletic shorts, such embodiments can be used in other contexts, such as swimsuits, non-athletic shorts, casual wear, or longer garments, such as trousers or pants, whether for athletic or therapeutic purposes. Furthermore, various applications of such embodiments and modifications thereto, which may occur to those who are skilled in the art, are also encompassed by the general concepts described herein.

At least some of the embodiments disclosed herein reflect the realization that conventional garment designs have fixed inflexible attachment systems and/or are configured to tightly attach an inner short to an outer short, which limits the adjustability and mobility between the inner and outer shorts. These shortcomings make athletic shorts uncomfortable for use in an active environment, and decrease the wearer's performance. In contrast, embodiments of the athletic garments described herein provide a flexible, movable, "floating" suspension system configured to attach an inner short to an outer short.

According to some embodiments, the suspension system flexibly attaches an inner short to an outer short in a manner that provides a wide range of movement between the two shorts when a force is applied thereto. The suspension system can be configured to permit such movement in a variety of directions, including circumferential, radial, axial, horizontal, lateral, and/or vertical (inferior-superior) movement. In some embodiments, the suspension system can be biased to return the inner short and the outer short to a comfortable default or "at rest" position when an applied force is removed from the shorts.

In some embodiments, the inner short and the outer short can be suspended relative to each other. For example, the inner short can be secured to the wearer and the outer short can be suspended and movable relative to the inner short and the wearer. In some embodiments, the inner short can be generally fixed relative to the wearer.

At least some of the embodiments described herein also reflect the realization that the selection of the materials used in the inner short and the outer short can also provide superior flexibility and movement between the two shorts, and with respect to the wearer. Such selection of materials can be implemented in combination with the embodiments of the inner short, outer short and suspension system described herein, to provide additional performance and comfort.

Figure 2:
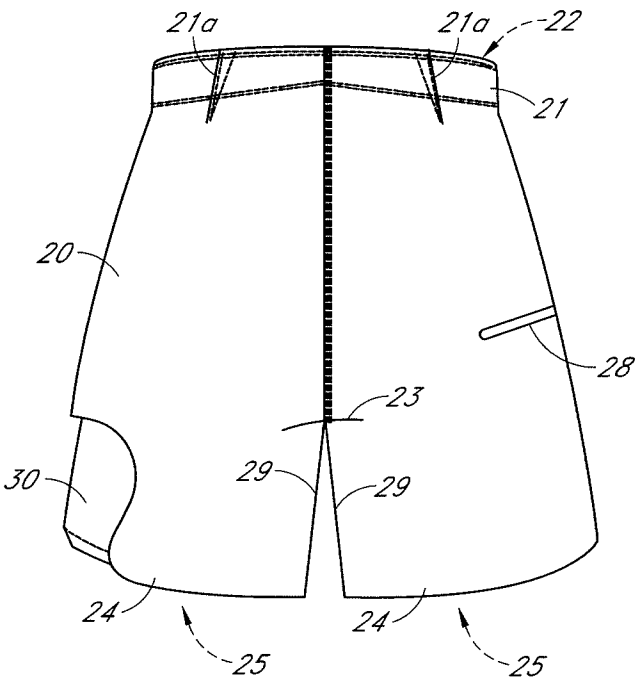
FIGS. 1 and 2 are front and rear views, respectively, of an embodiment of an athletic short comprising an outer short attached to and suspended from an inner short. The left leg of the outer short is partially cut away to reveal the inner short.
Figure 1:
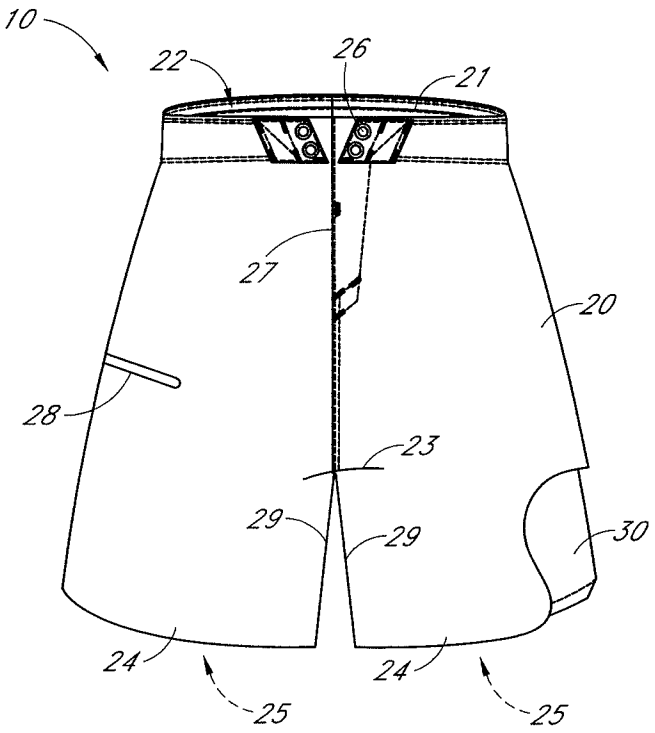

FIGS. 1 and 2 are front and rear views, respectively, of an embodiment of a garment, shown here as athletic shorts 10, comprising an inner short 30 configured to be attached to and worn in combination with an outer short 20. For example, in some embodiments, the inner short 30 can be removably attached to the outer short 20. Further, the outer short 20 can be suspended from the inner short 30 when the inner short 30 is worn by a wearer. The interconnection between the inner short 30 and the outer short 20 can be configured to provide superior flexibility, comfort, and adjustability. Various interconnection means can be employed to provide these advantages, such as those discussed herein.

Referring to FIGS. 1 and 2, outer short 20 can comprise an upper region with a waist portion (e.g., a waistband) 21 that forms a waist opening 22 configured to surround a wearer's waist. The body of the outer short 20 can extend downwardly from the waistband 21 and opening 22 to a crotch portion 23. The outer short 20 can comprise a lower region with a pair of left and right leg portions 24 extending downwardly from crotch portion 23 along an inseam 29, each leg portion 24 forming a leg opening 25 through which a wearer can extend his or her leg. The distance between the waistband 21 and the crotch portion 23 is defined herein as the "outer short crotch depth," as described further below.

In some embodiments, the outer short 20 can comprise a waist securing mechanism 26 (see also FIGS. 13A and 13B) and/or a fly portion 27 (see also FIGS. 14A and 14B) to assist a wearer in removing and attaching outer short 20. The waist securing mechanism 26 and/or fly portion 27 are optional. For example, the outer short 20 can be configured with a continuous or unbroken waist portion 21 (e.g., using a stretchable or elastic waist) around the upper region of outer short 20 (e.g., around opening 22).

The outer short 20 can comprise any of many various materials, and typically comprises a durable, lightweight, breathable, water resistant, and/or washable material, such as nylon or the like, that is suitable for use in many different environmental conditions (e.g., chlorinated or salt water). The outer short 20 can comprise any of a number of different materials with different strength and elongation properties, to provide superior comfort, support, protection, and/or performance. For example, outer short 20 can comprise polyester (e.g., peached polyester, microsuede polyester (e.g., recycled microsuede polyester), woven polyester, etc.), nylon, spandex, etc. Outer short 20 can be formed from a fabric or textile layer comprising two or more materials, such as a blended yarn (e.g., nylon/spandex, polyester/spandex, etc.). In some embodiments, outer short 20 can comprise 100% polyester, to provide desired strength and elongation properties. In some embodiments, outer short 20 can comprise a polyester/spandex blend within certain ranges and values, to provide different strength and elongation properties. For example, the percentage of polyester used in outer short 20 can range from approximately 70% to approximately 100%. The percentage of spandex used in outer short 20 can range from approximately 0% to approximately 30%. In one embodiment, the percentage of polyester and percentage spandex used in outer short 20 is approximately 74% and approximately 26%, respectively. In one embodiment, the percentage of polyester and percentage spandex used in outer short 20 is approximately 80% and approximately 20%, respectively. In one embodiment, the percentage of polyester and percentage spandex used in outer short 20 is approximately 89% and approximately 11%, respectively. In one embodiment, the percentage of polyester and percentage spandex used in outer short 20 is approximately 94% and approximately 6%, respectively. Outer short 20 can include two or more textile or fabric layers, with the layers having similar or different properties with respect to each other, and/or with one or more materials used for each layer.

The construction of the fabrics used for outer short 20 can also be selected to provide different strength and elongation properties. For example, outer short 20 can comprise woven or mesh textiles consisting of intersecting threads or yarns meshed or crossing each other at angles with respect to each other (e.g., approximately orthogonally, at 45 degrees, etc.). Some woven or mesh textiles can be used that include spaces or cells formed between the sets of intersecting threads. Additionally, non-woven textiles can be used with various strength and elongation properties. For example, non-woven textiles can be used to provide additional bulk or strength (e.g., reinforcement) to outer short 20.

In some embodiments, the type and/or construction of the material selected for outer short 20 can provide an elongation of outer short 20 within a range of between about at least 25% and/or less than or equal to about 150%. In some embodiments, the elongation of outer short 20 can be within a range of between about at least 40% and/or less than or equal to about 130%. In some embodiments, the elongation of outer short 20 can be within a range of between about at least 50% and/or less than or equal to about 80%. In some embodiments, the elongation of outer short 20 can be about 65%. As used with respect to specific ranges or values provided herein, "elongation" refers to the ratio of the extension of a portion of outer short 20 to the length of the portion of outer short 20 prior to stretching, expressed as a percentage, and measured at the point of tensile failure (or rupture) of the material.

In some embodiments, the type and/or construction of the material selected for outer short 20 can provide a tensile strength of outer short 20 within a range of between about at least 20 lbf and/or less than or equal to about 160 lbf. In some embodiments, the tensile strength of outer short 20 can be within a range of between about at least 35 lbf and/or less than or equal to about 145 lbf. In some embodiments, the tensile strength of outer short 20 can be within a range of between about at least 55 lbf and/or less than or equal to about 90 lbf. In some embodiments, the tensile strength of outer short 20 can be about 65 lbf. As used with respect to specific ranges or values provided herein, "tensile strength" refers to the maximum tensile force applied to outer short 20 prior to tensile failure of outer short 20.

The materials used for outer short 20 can also be configured such that the strength and elongation properties of outer short 20 can be different in different directions. For example, the cell spacing and/or the thickness of the threads used in a first direction to form a fabric (e.g., a knit or woven fabric) can be different from the cell spacing and/or thread thickness used in a second direction, to provide a different strength and/or elongation in the first direction with respect to the second direction. For example, a greater horizontal stretch may be desired for outer short 20 than a vertical stretch, or vice versa. In some embodiments, the elongation of the material used for outer short 20 in a first direction (prior to tensile failure) can be different from the elongation of the material in a different direction (e.g., approximately orthogonal) by a factor within a range of between about at least 1.0 and/or less than or equal to about 2.5. In some embodiments, the elongation of the material used for outer short 20 in a first direction can be different from the elongation of the material in a different direction by a factor within a range of between about at least 1.5 and/or less than or equal to about 2.0.

Waistband 21 can comprise any of the materials or combinations of materials described herein generally for outer short 20, to provide various levels of strength and elongation, and can comprise the same or different materials than the remainder of outer short 20. In some embodiments, the construction of the waistband 21 (e.g., through material selection, material or layer arrangement, stitching type or pattern) can be selected to provide less stretch relative to a remainder of the outer short 20. In other embodiments, the waistband 21 can have generally equal or greater stretch properties compared to a remainder of the outer short 20. The materials for waistband 21 may be selected to allow waistband 21 to stretch and flex, and to return to its original state (e.g., size) over time, such that outer short 20 retains a comfortable fit around a wearer's waist over time. In some embodiments, waistband 21 comprises two or more materials and/or layers of material(s), with a first material or layer selected for greater elasticity with respect to a second material or layer, and the second material or layer selected for greater strength with respect to the first material or layer. For example, some embodiments of waistband 21 can comprise one or more layers comprising a woven polyester, a microsuede polyester (e.g., recycled microsuede polyester) and/or a polyester/spandex blend (for elasticity), and a non-woven reinforcement material (for strength). In embodiments that include a polyester/spandex blend, any of the aforementioned percentages of polyester and spandex with respect to each other described for outer short 20 can be employed with waistband 21. In a preferred embodiment, waistband 21 comprises three layers of material, a first layer comprising 100% polyester or a polyester/spandex blend, a second layer comprising a non-woven reinforcement material, and a third layer comprising a recycled polyester microsuede or a woven polyester. Any of the aforementioned combinations of two, three or more materials or layers of material (s) with such relationships between their elasticity and strength properties can also be implemented in other portions of outer short 20.

In some embodiments, the type and/or construction of the materials selected for waistband 21 can provide an elongation of waistband 21 within a range of between about at least 3% and/or less than or equal to about 100%. In some embodiments, the elongation of waistband 21 can be within a range of between about at least 10% and/or less than or equal to about 90%. In some embodiments, the elongation of waistband 21 can be within a range of between about at least 30% and/or less than or equal to about 70%. In some embodiments, the elongation of waistband 21 can be about 50%.

In some embodiments, the type and/or construction of the material selected for waistband 21 can provide a tensile strength of waistband 21 within a range of between about at least 55 lbf and/or less than or equal to about 250 lbf. In some embodiments, the tensile strength of waistband 21 can be within a range of between about at least 75 lbf and/or less than or equal to about 200 lbf. In some embodiments, the tensile strength of waistband 21 can be about 180 lbf. In some embodiments, the tensile strength of the waistband 21 can be equal to or greater than about 150 lbf. or 200 lbf.

When used in some embodiments, the waist securing mechanism 26 can comprise any of many different configurations that assist a wearer in securing (e.g., tightening) and removing (e.g., loosening) outer short 20 around his or her waist, such as one or a combination of snaps, buttons, hook/loop fasteners (e.g. Velcro®), strings, belts, straps, ties, elastic bands, etc. Fly portion 27 can comprise one or more removably engagable flaps or layers 27*a*, 27*b* (FIGS. 14A, 14B) that can be engaged and separated along the upper portion of outer short 20 (e.g., a portion of outer short 20 extending between waist 21 and crotch portion 23). Flaps 27*a*, 27*b* can allow opening 22 to expand, to facilitate removal of outer short 20, and contract, to facilitate the securing of outer short 20 around a wearer's waist. The waist securing mechanism 26 and/or the fly portion 27 can comprise one or more stretchable (e.g. elastic) portions to provide improved fit and/or to facilitate the securing and removal of outer short 20.

Figure 3B:
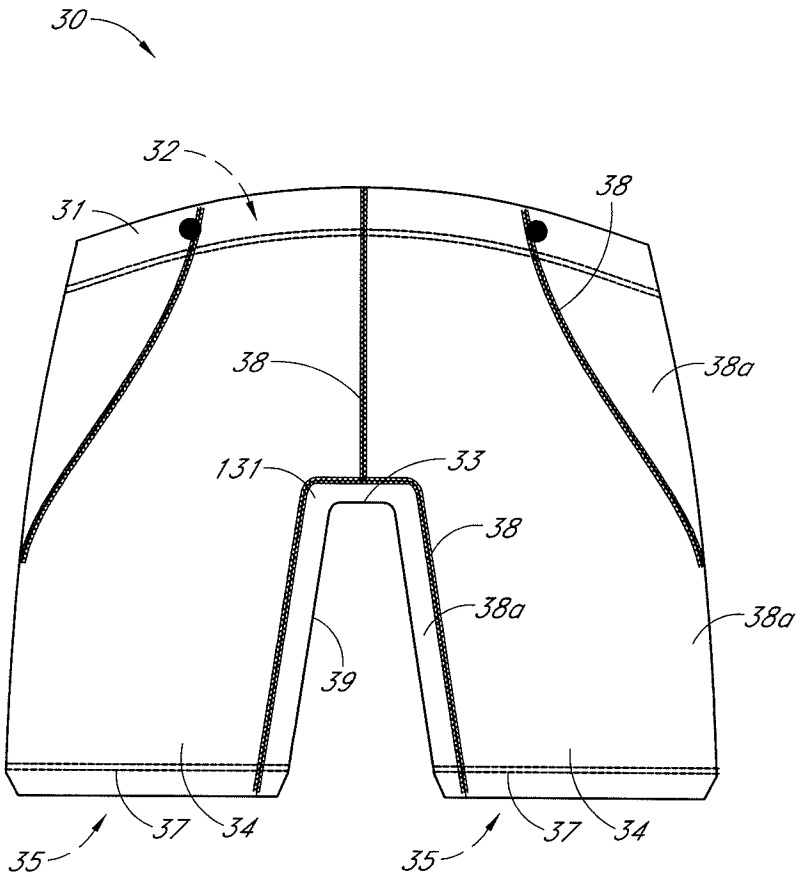
FIGS. 3A and 3B are front and rear views, respectively, of an embodiment of an inner short.
Figure 3A:
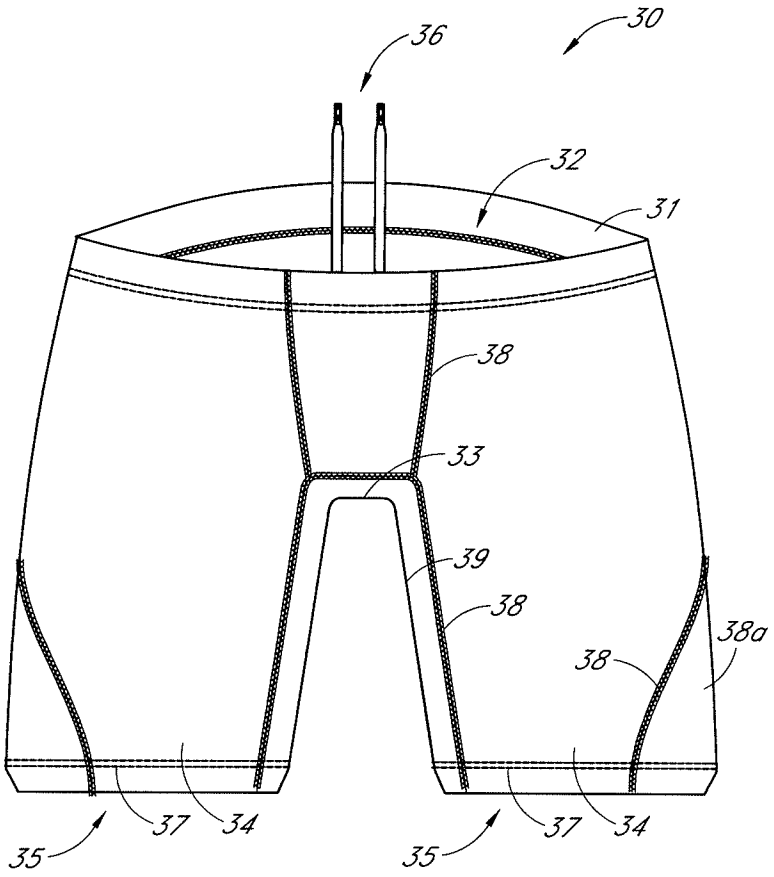

FIGS. 3A and 3B are front and rear views, respectively, of an embodiment of the inner short 30. The inner short 30 can comprise an upper region with a waist portion (e.g., waistband) 31 that forms an opening 32 configured to surround a wearer's waist. The body of the inner short 30 can extend downwardly from the waistband 31 and opening 32 to a crotch portion 33. The inner short 30 can comprise a lower region with a pair of leg portions 34 extending downwardly from crotch portion 33 along an inseam 39, each leg portion 34 forming an opening 35 through which a wearer can extend his or her leg, similar to those features described herein for outer short 20. The distance between the waistband 31 and the crotch portion 33 is defined herein as the "inner short crotch depth."

In some embodiments, the shape of crotch portion 33 and the inner short crotch depth can be configured to prevent interference (e.g., chafing) between crotch portion 33 and crotch portion 23 (FIGS. 1 and 2). For example, when worn the outer short 20 can be suspended from the inner short 30, while allowing movement of outer short 20 relative to inner short 30 in various ranges and directions. Inner short 30 can comprise a separable fly portion substantially similar to fly portion 27 described herein for outer short 20.

Referring again to FIGS. 3A and 3B, inner short 30 is shown for illustrative purposes with a continuous or unbroken waist portion 31 around its upper region. Inner short 30 can comprise a waist securing mechanism 36 substantially similar to waist securing mechanism 26 (FIGS. 1 and 2), illustrated here as a pair of drawstrings.

The inner short 30 (including waist portion 31) can comprise any of the aforementioned variety of materials, textile layer(s) and configurations described for outer short 20 and waist portion 21, to provide a similar superior comfort, support, protection and performance of short 30. Inner short 30 can comprise a durable, lightweight, breathable, water resistant, and/or washable material that can be used in many different environmental conditions (e.g., chlorinated or salt water). Inner short 30 and waist portion 31 can include a type and construction of material that provides an elongation and/or strength within any of the aforementioned ranges described for outer short 20 and waist portion 21. The elongation and/or strength of outer short 20, waist portion 21, inner short 30, and/or waist portion 31 can be varied with respect to each other, to affect the movement of these components with respect to each other when implemented in combination with a suspension system, as described further below.

In some embodiments, the inner short 30 can comprise a material that closely conforms to, compresses, and/or tightly fits around a wearer's body, such as lycra (e.g., Spandex®) and/or neoprene. Using a compressive material for inner short 30 can provide support to the wearer and keep the wearer's muscles warm to prevent muscle strain and fatigue, and/or wick fluid (e.g., sweat, and salt/chlorinated water) away from the body to prevent chafing and rashes during athletic activities. For example, elastic, panels, and/or stitched seams can be positioned to conform to or follow the contours of various anatomical portions of the wearer's body, such as certain muscles or muscle groups. In some embodiments, inner short 30 can comprise padding and/or regions formed from a soft material (e.g., regions proximate to the hips, genitalia, buttocks, coccyx, etc) for comfort and/or to protect the wearer from injury, caused for example, by surfboard impact.

In some embodiments, the inner short 30 can comprise a compression short. A compression short can be a form-fitting garment that extends from the athlete's waist to the mid or lower thigh. The compression short can be made from a spandex-type material, similar to cycling shorts. One of the benefits of compression shorts is that they keep the muscles warm to prevent muscle strain and fatigue, and wick sweat away from the body to prevent chafing and rashes. In addition, there is some evidence that compression shorts may enhance athletic performance, as well as provide comfort and support for the body. Further, the compression shorts can also help to keep other types of undergarments or protective padding in place. For example, for some sports (e.g. baseball and softball), the compression short can comprise padding at the hips to protect players from injuries due to sliding. In some embodiments, the inner short 30 can be constructed from neoprene or a similar material that renders the inner short 30 suitable for use as an insulating layer, such as for use in water sports.

Shorts 20, 30 can comprise various elastic portions, textile panels, darts (e.g., folds of stitched material), and/or stitched regions (e.g., seams) configured to provide a certain aesthetic appeal, and/or for improved fit and comfort to the wearer. For example, FIGS. 3A and 3B show an illustrative example of a leg gripper 37 (e.g., elastic or gripper material) positioned proximate to and extending around the perimeter of leg openings 35, to prevent leg portions 34 from riding up during use of inner short 30. Further, the inner short 30 can also comprise a plurality of panels 38*a* connected by seams or stitched regions 38 to provide improved fit in specific areas (e.g., the hip flexors, crotch, inseam, buttocks, and/or quadriceps).

Referring to FIG. 2, outer short 20 is shown with one or more darts 21*a* positioned around waistband 21. In some embodiments, the shorts 20 and/or 30 can be configured with various elastic regions, stitched regions, darts and panels that function substantially similar to the darts 21*a* shown in FIG. 2, and the elastic regions 37, stitched regions 38, and panels 38*a* shown in FIGS. 3A and 3B.

Figure 4B:
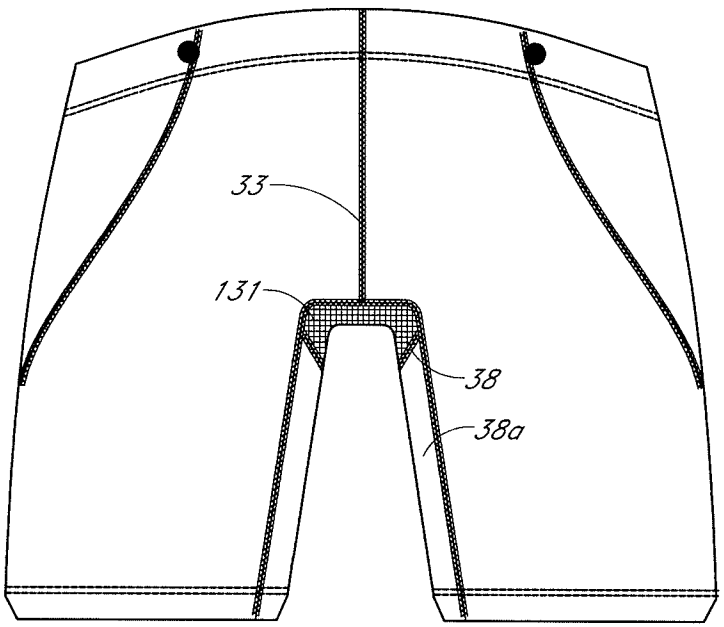
FIGS. 4A and 4B are front and rear views, respectively, of another embodiment of an inner short.
Figure 4A:
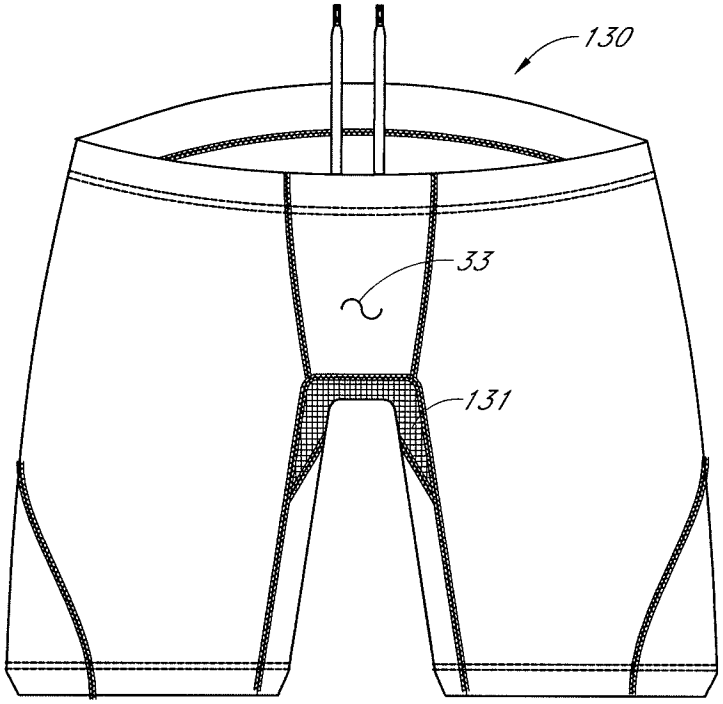

FIGS. 4A and 4B are front and rear views, respectively, of an embodiment of an inner short 130. Inner short 130 can be similar to and function substantially similar to inner short 30. In the illustrative embodiment, inner short 130 comprises a vent 131 positioned proximate to crotch portion 33 of inner short 130, to provide ventilation to the wearer's skin. Vent 131 can comprise a mesh, net, or other material with improved breathability and, in some embodiments, improved wicking properties relative to the remainder of the material of inner short 130. In some embodiments, vent 131 can be configured without material (e.g., as an opening or aperture), to provide a ventilation opening through inner short 130.

In some embodiments, the shorts 10 can be adapted to employ one or more vents similar to vent 131 in various areas of outer short 20, inner short 30, and/or inner short 130, such as at least one or more of the crotch, left and right inseam, waist, lateral sides, etc., and can be positioned in various orientations, including horizontal, vertical, or any angled orientation, relative to these components. Vent 131 can also comprise any of a variety of shapes suitable to provide ventilation through shorts 10 to a wearer.

Figure 7:
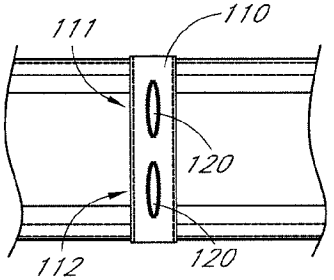
FIG. 7 is an enlarged front view of a portion of the outer short of the suspension system of FIG. 5, according to an embodiment.
Figure 8:
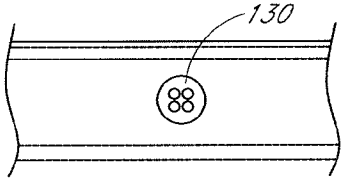
FIG. 8 is an enlarged rear view of a portion of the inner short of the suspension system of FIG. 5, according to an embodiment.
Figure 5:
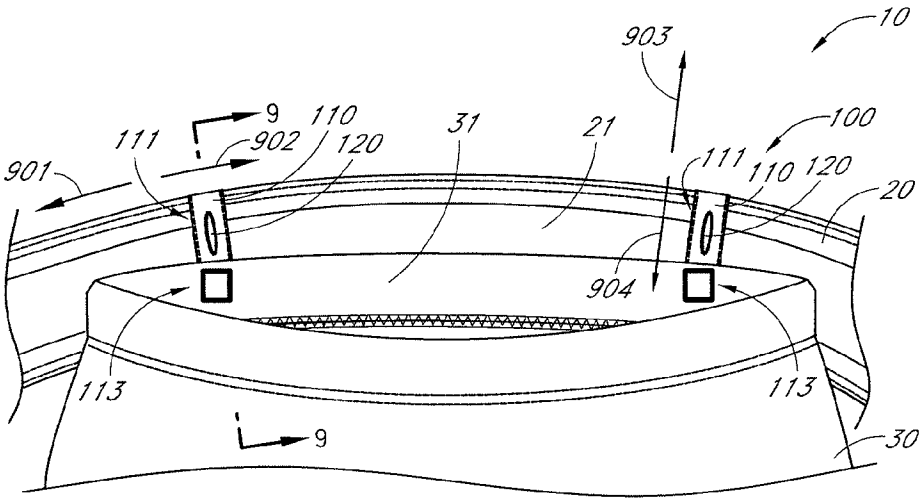
FIG. 5 is a front view of an embodiment of a garment suspension system for suspending an outer short from an inner short.
Figure 6:
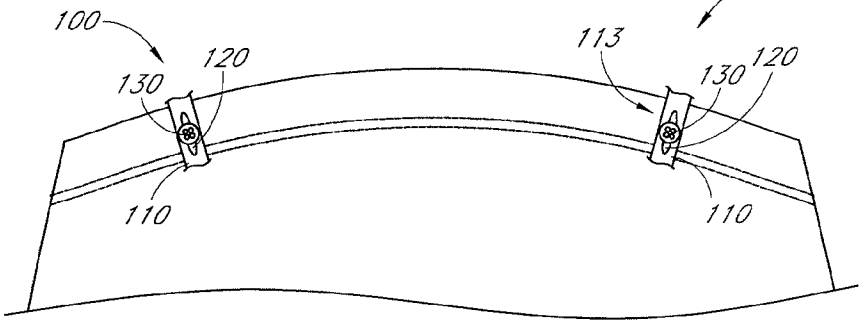
FIG. 6 is a partial rear view of an embodiment of the suspension system of FIG. 5.
Figure 9A:
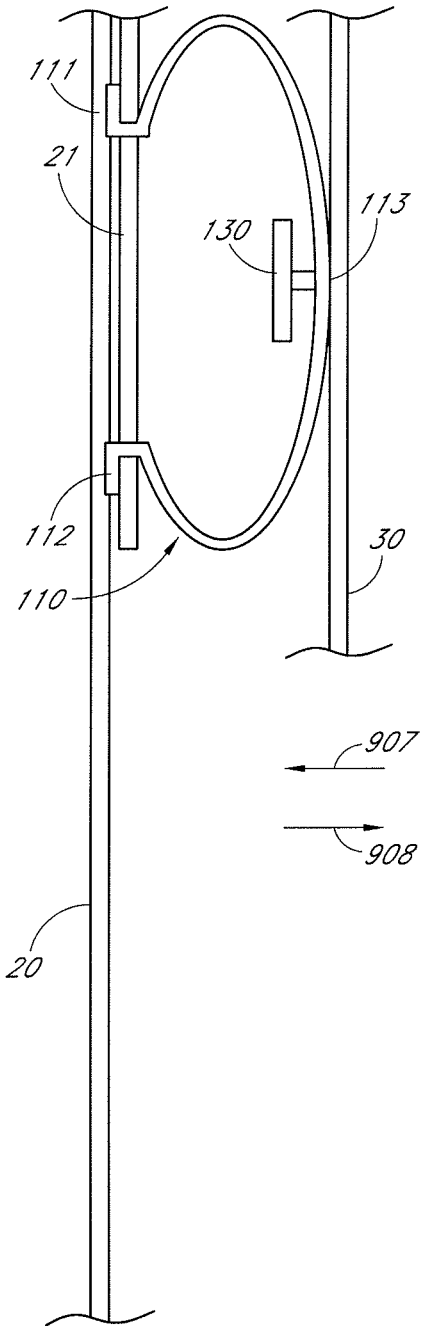
FIG. 9A is an enlarged side cross-sectional view of the suspension system taken along line 9A-9A of FIG. 5.

FIG. 5 is a front view of an embodiment of a suspension system 100 for attaching the inner short 30 to the outer short 20, and suspending the outer short 20 from the inner short 30 (or vice versa) to form, in combination, the combination athletic short 10 of FIGS. 1 and 2. FIG. 6 is a partial rear (posterior) view of the embodiment of the suspension system 100 shown in FIG. 5. FIG. 7 is a close-up, partial front (anterior) view of the suspension system 100 of FIG. 5. FIG. 8 is a close-up, partial rear (posterior) view of suspension system 100 of FIG. 5. FIG. 9A is a close-up, partial side cross-sectional view of suspension system 100 taken along line 9A-9A of FIG. 5.

In some embodiments, the suspension system 100 can be used to support the outer short 20 from the inner short 30 along the top or upper rim of the inner short 30. In some embodiments, the suspension system 100 supports the outer short 20 from the inner short 20 only along the top of the inner short 30. However, other embodiments can be provided that support the outer short 20 from the inner short 30 along the lower leg portion, such as bottom rims of leg portions of the shorts 20, 30. Thus, embodiments can be provided that are supported along the top and/or bottom of the shorts.

Referring to FIGS. 5-9, the suspension system 100 can comprise one or more suspension elements or structures 110 configured to attach the outer short 20 to the inner short 30. Suspension element 110 can be configured to allow movement or adjustment of shorts 20, 30 relative to each other, in one or more of a variety of directions. For example, in some embodiments, one or more suspension elements attached to the inner short can be interconnected with one or more corresponding suspension elements attached to the outer short. Thus, in some embodiments, the shorts 20, 30 can move or adjust relative to each other without allowing shorts 20, 30 to become detached or unsecured from each other during use. Further, the relative movement or adjustment can be automatic or self-accomplished (e.g., the outer short 20 can float or be resiliently suspended from the inner shorts 30 during use). In some embodiments, the various types and construction of materials described herein and selected to provide strength and elongation to shorts 20, 30 and/or waist portions 21, 31, can be used in combination with suspension system 100 to provide additional movement and adjustment of shorts 20, 30 relative to each other.

Figure 9C:
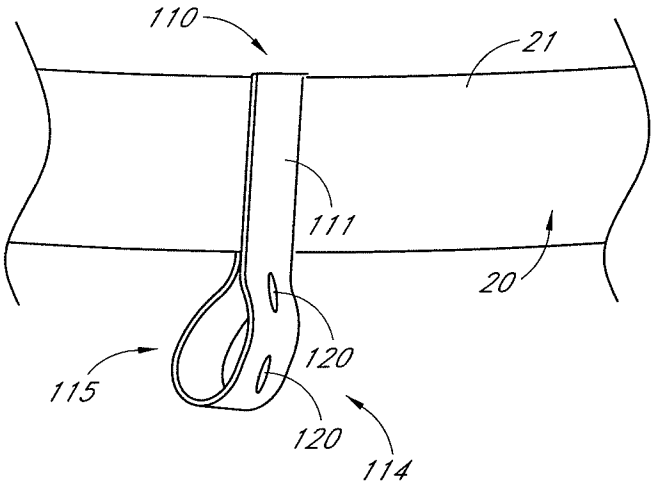
FIGS. 9B and 9C are enlarged front views of embodiments of a suspension element.
Figure 9B:
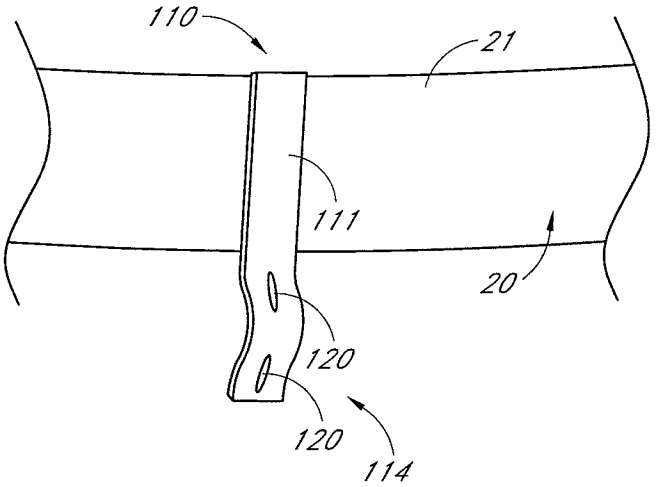

For example, suspension element 110 can be configured to allow shorts 20, 30 to move or flex relative to each other in a circumferential (e.g., FIG. 11B, arrows 905, 906), horizontal (e.g., FIG. 5, arrows 901, 902), vertical or axial (e.g., FIG. 5, arrows 903, 904), or radial (e.g., FIG. 11A, arrows 907, 908) direction, or any combination thereof. Embodiments of the suspension element 110 are illustrated in FIGS. 9A-C.

For example, in some embodiments, the suspension element 110 can provide relative movement of connected portions, attachment points, or attachment structures of the shorts 20, 30 within a range of between about at least ½ inches and/or less than or equal to about 5 inches. In some embodiments, the range of relative movement of connected portions of the shorts 20, 30 can be within a range of between about at least 2 inches and/or less than or equal to about 4 inches. Further, in some embodiments, the range of relative movement of connected portions of the shorts 20, 30 can be about 3 inches. The range of motion between the connected portions of the shorts 20, 30 can be measured in any one or more of the directions noted above (circumferential, horizontal, vertical, axial, radial, or combinations thereof).

In some embodiments, the types and construction of the materials selected for shorts 20 and/or 30 can be used in combination with suspension system 100 to influence (e.g., enhance) the aforementioned relative ranges of movement between shorts 20 and 30. For example, the elongation properties of the materials used in shorts 20 and 30 can increase the aforementioned relative movement of connected portions of the shorts 20, 30 by a factor within a range of between about at least 1.05 and/or less than or equal to about 2.5. Further, in some embodiments, the materials used in shorts 20 and 30 can increase the aforementioned relative movement of connected portions of the shorts 20, 30 by a factor within a range of between about at least 1.25 and/or less than or equal to about 1.75. Further, in some embodiments, the materials used in shorts 20 and 30 can increase the aforementioned relative movement of connected portions of the shorts 20, 30 by a factor of about 1.5.

Furthermore, in some embodiments, the suspension element 110 can be configured to provide a directional bias between shorts 20 and 30, described further herein. Such directional bias can also be influenced (e.g., enhanced) through the selection of materials for shorts 20 and/or 30 with various strength and elongation properties.

In some embodiments, suspension element 110 and/or the material selection of shorts 20, 30 can be configured with sufficient vertical play or movement between shorts 20, 30, such that a portion of inner short 30 can be exposed above the outer short 30 when shorts 10 are in an as-worn configuration. Accordingly, with a given amount of vertical play or adjustability, the shorts 10 can provide exceptional comfort and adjustability between the outer and inner shorts 20, 30.

For example, in some embodiments, the suspension element 110 can provide relative axial or vertical movement of connected portions or attachment points of the shorts 20, 30 within a range of between about at least ½ inches and/or less than or equal to about 5 inches. In some embodiments, the vertical range of relative movement of connected portions of the shorts 20, 30 can be within a range of between about at least 2 inches and/or less than or equal to about 4 inches. Further, in some embodiments, the vertical range of relative movement of connected portions of the shorts 20, 30 can be about 3 inches.

In some embodiments, the types and construction of the materials selected for shorts 20 and/or 30 can be used in combination with suspension system 100 to influence (e.g., enhance) the aforementioned relative vertical movement between shorts 20 and 30. For example, the elongation properties of the materials used in shorts 20 and 30 can increase the aforementioned relative vertical movement of connected portions of the shorts 20, 30 by a factor within a range of between about at least 1.05 and/or less than or equal to about 2.5. Further, in some embodiments, the materials used in shorts 20 and 30 can increase the aforementioned relative vertical movement of connected portions of the shorts 20, 30 by a factor within a range of between about at least 1.25 and/or less than or equal to about 1.75. Further, in some embodiments, the materials used in shorts 20 and 30 can increase the aforementioned relative vertical movement of connected portions of the shorts 20, 30 by a factor of about 1.5.

As discussed further below, in some embodiments, the suspension element 110 can be configured as a strip, strap (see FIG. 9B), belt, tie, loop (see FIGS. 9A and 9C) or other similar structure of sufficient length and with sufficient play to allow such freedom of movement. For example, as shown in FIG. 9B, if the suspension element 110 is a single strap, the length of the strap between connected portions or attachment points can be within the ranges noted above, such as between about at least 2 inches and/or less than or equal to about 5 inches. Of course, a greater length of material can enable the outer short 20 to be worn in a looser lower hanging style, as noted above. Further, the loop embodiment shown in FIG. 9A may require a greater length of material in order to secure the loop at top and bottom ends thereof.

FIGS. 5-7 and 9A-C illustrate embodiments of a suspension element 110 comprising a strip or loop of material attached to outer short 20. The suspension element 110 can be attached to outer short 20 at one of various portions along the length and/or width of suspension element 110. In some embodiments, opposing portions (e.g., opposing ends) of element 110 can be attached to outer short 20 at attachment points 111, 112, to form a loop. It will be understood that although element 110 is shown in a vertical orientation with its opposing ends attached to either side of waist band 21, element 110 can be oriented and attached to various portions of shorts 20, 30 at many different angles, alignments, and offsets. For example, attachment points 111, 112 can be horizontally, vertically, or circumferentially aligned or offset relative to each other.

In some embodiments, suspension element 110 can be configured to bias the outer short 30 with respect to the inner short 20. In some embodiments, the material types and construction selected for shorts 20 and 30 can bias the outer short 30 with respect to the inner short 20. Such a biasing force can cause element 110 and/or a biased or elongated portion of shorts 20, 30 to return or "rebound" to a quiescent, or "at rest"

position after a force is removed from shorts 20 and/or 30. For example, in use, when a force is applied to short 20 or 30 in any direction or any combination of directions 901 (FIG. 5), 903 (FIG. 5), 905 (FIGS. 9, 11), and/or 907 (FIGS. 9, 11), short 20 or 30 can move in that direction relative to the other of short 20 or 30. When said force is removed, a bias in element 110 can cause the short 20 or 30 to move in the opposite direction (e.g., any of or any combination of directions 902, 904, 906 and/or 908, respectively), and return to its quiescent or "at rest" position. The suspension element 110 and/or the material selection for shorts 20 and 30 can therefore provide a vertical and/or horizontal biasing force to influence the relative positioning and/or articulation of the outer and inner shorts 20, 30. The bias in suspension element 110 can be provided through the selection of the shape, material, positioning, and/or attachment of element 110.

The suspension element 110 can comprise a substantially elastic or a substantially non-elastic material. Further, the suspension element 110 can comprise any of various materials for shorts 20, 30, including those described herein, or various combinations thereof. In some embodiments, suspension element 100 can comprise a plastic, an elastic material, or other semi-rigid, yet flexible and resilient material to provide the bias within suspension element 110. In a preferred embodiment, suspension element 110 comprises a resilient plastic.

Referring to FIG. 9B, in some embodiments, element 110 can be attached at one end (e.g., at attachment point or region 111) to short 20 or 30, and can comprise a free end 114 that can be attached to the other of shorts 20, 30, to provide relative movement between shorts 20, 30. Referring to FIG. 9C, in some embodiments, element 110 can be attached at one end (e.g., at attachment point or region 111) to a portion of short 20 or 30, and free end 114 can be configured to form a floating looped portion 115 that can be attached to a corresponding attachment structure on the other of shorts 20, 30. Further, the embodiments shown in FIGS. 9B and 9C can also be inverted to extend upwardly instead of downwardly.

Accordingly, one or more suspension elements 110 can be attached to the outer shorts 20 and/or the inner shorts 30. The attachment of the suspension element 110 can be direct and/or indirect to the outer shorts 20 and/or the inner shorts 30. In some embodiments, the suspension element 110 can be attached to the outer short or inner short at one or two or more attachment points. For example, in the looped embodiment illustrated in FIGS. 5-9, the suspension element 110 can be attached to outer shorts 20 at attachment points or regions 111 and 112, and the suspension element can be removably coupled to inner shorts 30 at attachment point or region 113, as described further herein, or vice versa. That is, the construction shown and described herein can be reversed such that the suspension element 110 is coupled to the inner shorts 30 at two locations and the suspension element 110 is coupled to the outer shorts 20 at one location. Further, the suspension element 110 can be permanently or removably attached to either or both of inner short 30 and outer short 20.

In some embodiments, the suspension element 110 can be attached to shorts 20 and 30 using any of a variety of attachment techniques and/or structures, such as stitching, sewing, sonic bonding, chemical bonding, thermal bonding, mechanical fasteners (staples, rivets, buttons, hook/loop fasteners, snaps, zippers, etc.), and/or adhesives. Suspension element 110 can be attached to the outer shorts 20 using the same or different attachment technique(s) or structure(s) as the attachment of suspension element 110 of the inner shorts 30.

For example, suspension element 110 can be removably attached to both inner short 30 and outer short 20, to allow a wearer to attach and detach one of shorts 20, 30 from the other of shorts 20, 30, while allowing suspension element 110 to remain attached to the other of shorts 20, 30. Suspension element 110 can also be removably attached to both inner short 30 and outer short 20 to allow a wearer to remove and/or replace suspension element 110.

In some embodiments, the size and positioning of the suspension element(s) 110 can also be varied to provide desired movement, adjustability, etc. A wearer may select various types or quantities of suspension elements to be employed within athletic shorts 10, for a custom fit, or for improved performance based upon the activity for which shorts 10 are being used. For example, a wearer might use suspension elements of varying lengths, to provide varying amounts of movement to certain areas of shorts 20, 30. A wearer might use suspension elements of varying structural rigidity/flexibility, to vary the ease with which certain areas of shorts 20, 30 move relative to each other. The size, positioning, types, quantities, rigidity, and/or flexibility of suspension element (s) 110 can be varied and used in combination with the material selection for shorts 20, 30, to further enhance and provide a desired movement, adjustability, fit and performance of shorts 20 and 30.

In the embodiment illustrated in FIGS. 5-9, the suspension element 110 is shown attached to outer short 20 with stitching (e.g., to form attachment points or regions 111, 112), and attached to inner short 30 with one or more complementary removable attachment elements or structures 120, 130 (e.g., to form attachment point or region 113).

For example, the suspension element(s) 110 can be positioned on (e.g., attached to) various portions of outer short 20 and inner short 30, such as the inner and/or outer surfaces of shorts 20, 30, including portions of the flies, buttocks portions, leg portions, crotch, waist portions, etc. In some embodiments, suspension element 110 can be configured to be attached to an inner surface of outer short 20, and an outer surface of inner short 30.

In the embodiment shown in FIGS. 5-9, suspension element 110 is configured to be attached proximate to an inner surface of waist band 21 of the outer short, and an outer surface of waistband 31 of the inner short. By attaching element 110 proximate to waistband 21, element 110 can facilitate movement of inner short 30 relative to waistband 21 on outer short 20, when waistband 21 is secured (e.g., tightly or snugly secured) around a wearer's waist.

Accordingly, in some embodiments, the configuration of the suspension system and its components can also provide aesthetic or non-functional benefits. For example, the suspension element 110 can be configured with sufficient play to allow a portion of waistband 31 of inner short 30 to extend above the waistband 21 of outer short 20, and thus be viewable when shorts 10 are being worn, providing a "street" or "hip hop" style.

However, in some embodiments, the suspension element 110 can also be configured to allow the outer short 20 to hide or mask the inner short 30 while providing the outer short 20 with sufficient play or movement. In such embodiments, the length of the suspension element 110 between connected portions or attachment points can thus fall within lower ranges, such as between about at least 1 inch and/or less than or equal to about 3 inches. Thus, a desired amount of relative movement can be achieved while generally preventing a portion of inner short 30 from extending beyond the perimeter formed by outer short 30 when shorts 10 are in an as-worn configuration.

When suspension element 110 is used in combination with the stretchable materials described herein for shorts 20, 30, the aforementioned ranges of lengths of suspension element 110 can be decreased, while still preventing a portion of inner short 30 from extending beyond the perimeter formed by outer short 30. For example, the stretchable materials used in shorts 20 and 30 can decrease the lower ranges of the length of the suspension element 110 between connected portions by a factor within a range of between about at least 1.05 and/or less than or equal to about 1.25.

In some embodiments, a plurality of suspension elements 110 can be spaced (e.g., in equal or unequal intervals) around the perimeter (e.g., circumference) of openings 22, 32 of the shorts 20, 30. Preferably, a plurality of suspension elements can be spaced around the perimeter of waistband 21 and/or waistband 31. In some embodiments, the spacing of the suspension elements 110 relative to each other can be varied to provide a desired interconnectivity or support profile. In addition, the spacing of the attachment elements 130 relative to the suspension elements 110 can be configured to provide a desired degree of horizontal, vertical, circumferential, radial, axial or torsional movement between the outer and inner shorts 20, 30.

Figure 10:
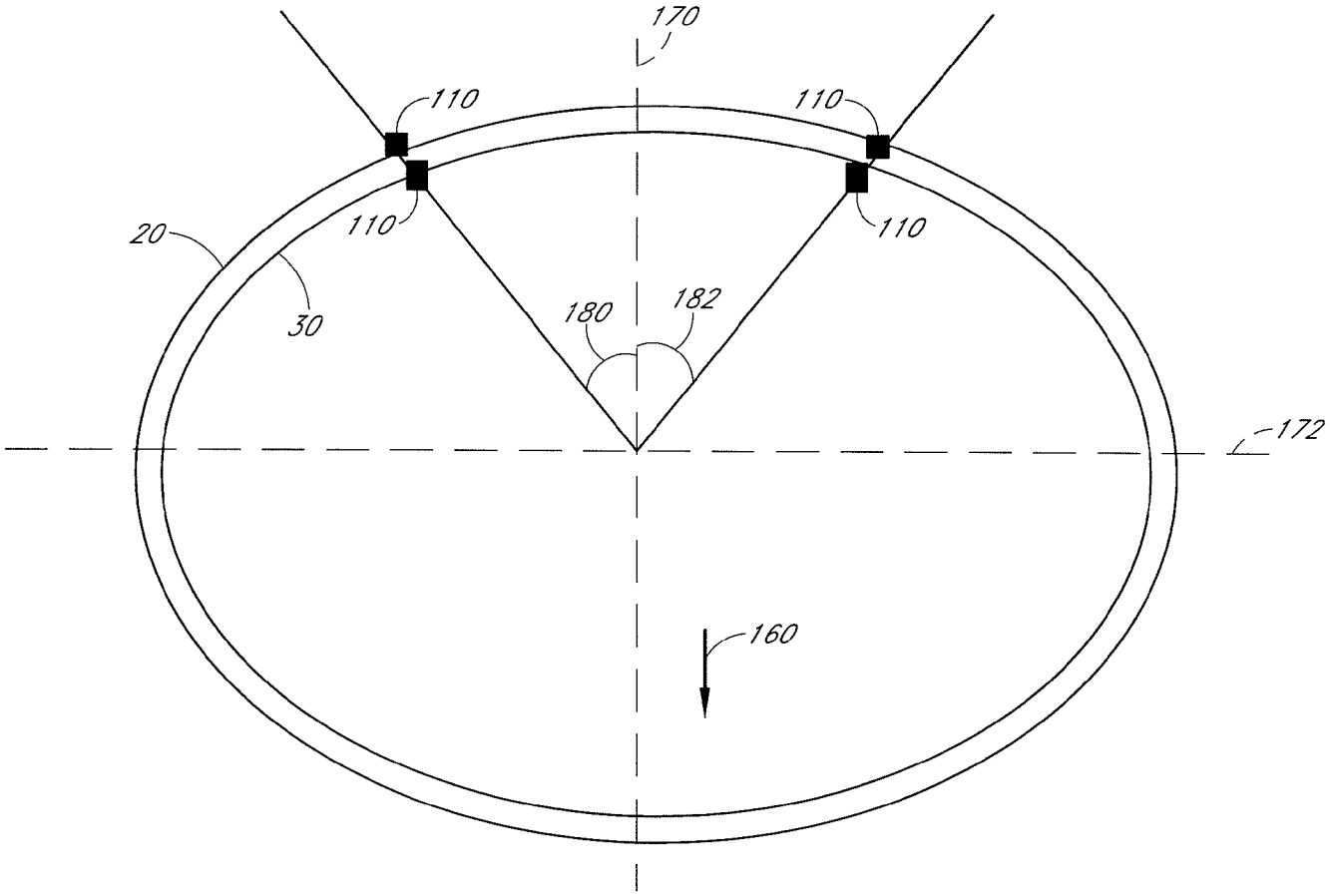
FIG. 10 is a top view of an athletic short wherein suspension elements are illustrated, according to an embodiment.

In some embodiments, a first and second suspension elements 110 can be attached to the outer shorts 20 in bilaterally symmetrical positions within the posterior half of the short. FIG. 10 illustrates an embodiment of the outer shorts 20 and the inner shorts 30, positioned relative to an anterior direction 160. The shorts 20 carry first and second suspension components 110. The suspension components 110 can be positioned within a circumferential range that lies between an anterior-posterior midline or medial plane 170 and a lateral midline 172. In some embodiments, the first and second suspension components 110 provide the only connections between the shorts 20 and 30. In other embodiments, additional connections can be provided in accordance with any of the structures disclosed herein or other suitable connections.

For example, the suspension components 110 can be angularly spaced from the midline 170 at angles 180, 182. In some embodiments, the angles 180, 182 can be equal. Further, some embodiments can be configured such that the angles 180, 182 can be between about at least 10 degrees and/or less than or equal to about 80 degrees. In some embodiments, the angles 180, 182 can be between about at least 30 degrees and/or less than or equal to about 50 degrees. Furthermore, in some embodiments, the angles 180, 182 can be about 45 degrees. Preferably, no suspension components will be provided on the anterior half of the short, and no suspension components will be provided within about 5° or 10° of the posterior midline 170. A first suspension component may be provided on a first posterior lateral line (e.g. angle 180 is 45°) and a second suspension component may be provided on a seconds posterior lateral line (e.g. angle 182 is 45°). Alternatively, a right pair and a left pair of suspension components may be provided each pair centered about the corresponding right and left posterior lateral line.

Additionally, in some embodiments, the suspension components 110 can overlap in a radial direction, such as shown in the embodiment of FIG. 10. However, the suspension components 110 can also be radially offset from each other. Thus, the spacing and position of the suspension components 110 can be selected to provide a desired articulation between the outer and inner shorts 20, 30.

In some embodiments, the suspension element 110 can be permanently attached to the outer short 20 or to the inner short 30 such as by stitching (at one or more attachment points 111, 112), and removably attached to the other short with button or other attachment elements 120, 130.

Further, in some embodiments, the attachment elements 120, 130 can be configured in various quantities and/or positions along the length and/or width of suspension element 110, to allow adjustment between at least a first and a second range of movement between shorts 20 and 30. The positioning and availability of attachment elements or structures of the suspension element 110 can allow the wearer to select a given distance or spacing within a range of motion mentioned herein.

For example, referring to FIG. 7, in some embodiments, the suspension element 110 can comprise more than one attachment element or position 120 illustrated as button holes. As illustrated, the suspension element 110 can have two attachment positions. Further, three or four or more can also be provided. The presence of multiple attachment positions allows the wearer to selectively modify the relative positioning of the shorts 20, 30. Thus, the shorts 20, 30 can be moved from a low-hanging style to a style in which the outer short generally hides the inner short.

Referring still to FIGS. 7-8, the attachment elements 120, 130 can comprise any of various complementary attachment mechanisms, such as buttons, snaps, zippers, rivets, hook/loops, etc. In the illustrated embodiment, the attachment elements 120 comprise button holes and the attachment element 130 comprises a button. The button holes 120 can comprise slits with sufficient length to allow insertion of and to secure a button, as is known, such that the attachment point 113 is fixed or substantially fixed relative to the suspension element 110. Using other attachment elements 120, 130, the attachment point 113 can be fixed relative to the strap, loop or suspension element 110. In some embodiments, button holes 120 can comprise slits of sufficient length to both allow insertion of and to secure a button, and to provide additional freedom of movement for shorts 20, 30 relative to each other. The additional freedom of movement can be of a length that is less than the range of movement provided by the suspension element 110 itself, such as those ranges described herein, and/or less than a distance between the attachment points or regions 111 and 112.

FIG. 5 shows an embodiment of athletic shorts 10 wherein the complementary attachment structures on each of the inner short 20 and outer short 30 are substantially circumferentially aligned relative to each other (e.g., wherein attachment points 111 and/or 112 or attachment element 120 are substantially colinear with attachment point 113 or attachment element 130 along a substantially vertical axis). The attachment elements or structures of the shorts can be circumferentially offset from each other when attachment points 111 and/or 112 or attachment element 120 are positioned or moved relative to attachment point 113 or attachment element 130 in the directions indicated by arrows 901 and 902. Thus, in some embodiments, shorts 20 and 30 can be horizontally offset from each other to provide a substantial freedom of movement or mobility between shorts 20 and 30. For example, the horizontal offset can be between at least about 0.5 inch and/or less than or equal to about 3 inches. In some embodiments, the horizontal offset can be between at least about 0.25 inch and/or less than or equal to about 2 inches.

Shorts 20, 30 can be used with the stretchable materials described herein in combination with suspension element 110 to decrease the aforementioned ranges of horizontal offset between shorts 20 and 30, while providing substantially similar freedom of movement. For example, the elongation properties of the materials used in shorts 20 and 30 can decrease the aforementioned horizontal offset of the shorts 20, 30 by a factor within a range of between about at least 0.25 and/or less than or equal to about 0.9. Further, in some embodiments, the materials used in shorts 20 and 30 can decrease the aforementioned horizontal offset of the shorts 20, 30 by a factor within a range of between about at least 0.5 and/or less than or equal to about 0.75.

Figures 11A, 11B:
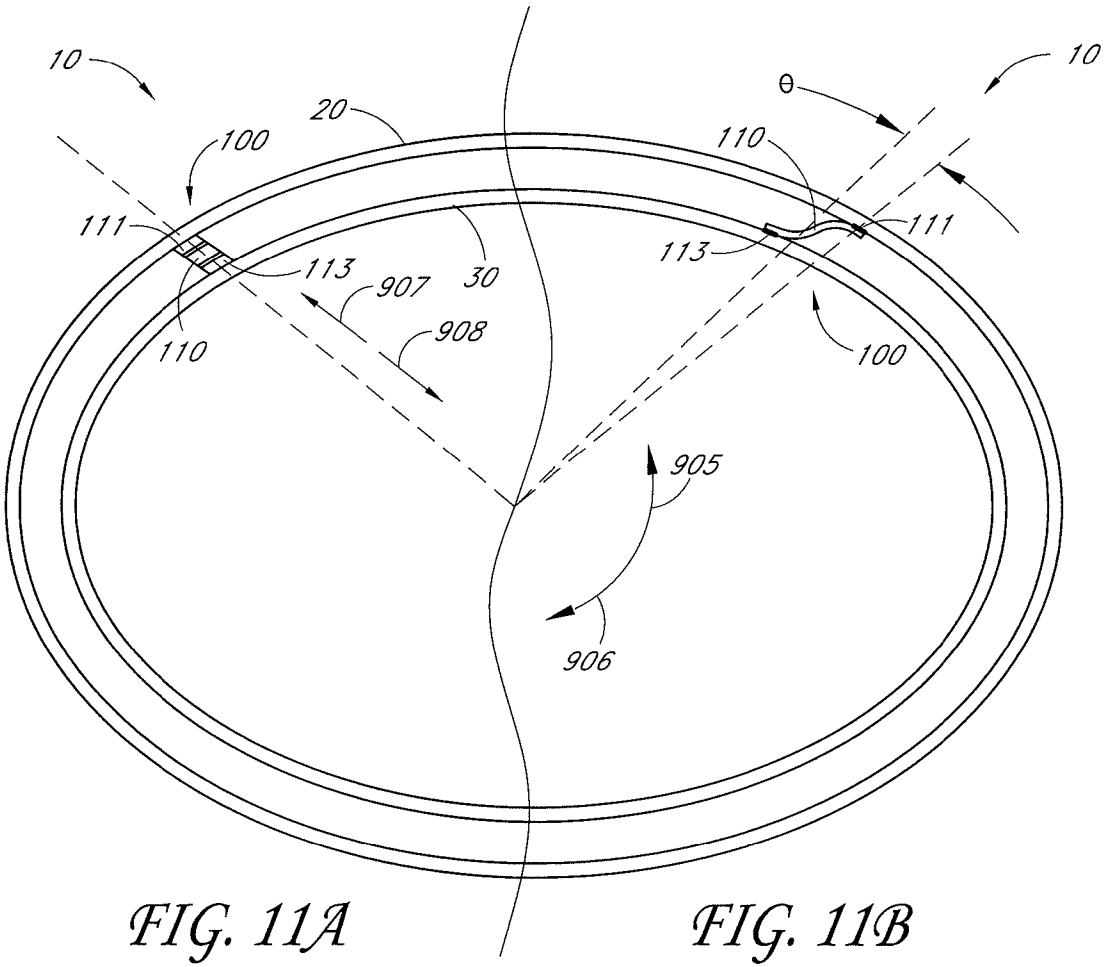
FIGS. 11A and 11B show partial top cross-sectional views of embodiments of athletic shorts.

FIGS. 11A-B show a split, top cross-sectional view of two embodiments of shorts 10. FIG. 11A illustrates an embodiment of shorts 10 wherein the outer short 20 is substantially circumferentially aligned with the inner short 30 (e.g., wherein attachment points or regions 111 and/or 112 or attachment element 120 are aligned substantially circumferentially or colinear with attachment point or region 113 or attachment element 130 along a radius extending from a center of shorts 10). FIG. 11B illustrates an embodiment of shorts 10 wherein attachment points or regions 111 and/or 112 or attachment element 120 are circumferentially offset by an angle θ in the directions shown by arrow 905 or 906 relative to attachment point or region 113 or attachment element 130. Such circumferential offset can provide a substantial freedom of movement or mobility between shorts 20 and 30. The aforementioned alignment (FIG. 11A) and offset (FIG. 11B) of attachment points or regions 111 and/or 112 or attachment element 120 can occur when suspension element 110 and/or shorts 20 and 30 are at a biased, or at rest position. The angle θ can be in the range of between about at least 5 degrees and/or less than or equal to at least about 40 degrees. In some embodiments, the angle θ can be in the range of between about at least 10 degrees and/or less than or equal to at least about 20 degrees. For example, in some embodiments, the angle θ can be about 15 degrees.

Shorts 20, 30 can be used with the stretchable materials described herein in combination with suspension element 110 to decrease the aforementioned ranges of circumferential offset between shorts 20 and 30, while providing substantially similar freedom of movement. For example, the elongation properties of the materials used in shorts 20 and 30 can provide a substantially similar freedom of movement when the angle θ is in the range of between about at least 2 degrees and/or less than or equal to at least about 35 degrees. In some embodiments, the angle θ can be in the range of between about at least 7 degrees and/or less than or equal to at least about 15 degrees.

Figure 12C:
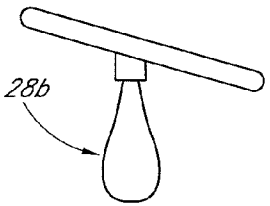
FIG. 12C shows a close-up front view of a loop that can be attached to an interior of a pocket, according to an embodiment.
Figure 12B:
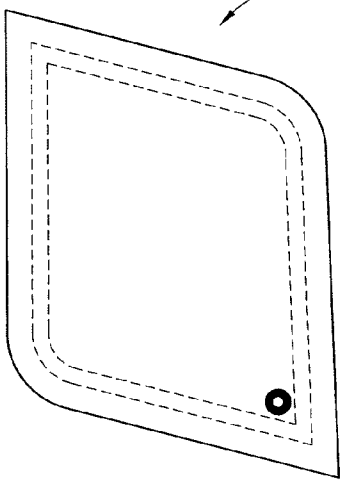
FIGS. 12A and 12B show a right side view and an enlarged left side view of a pocket attached to the athletic shorts, according to an embodiment.
Figure 12A:
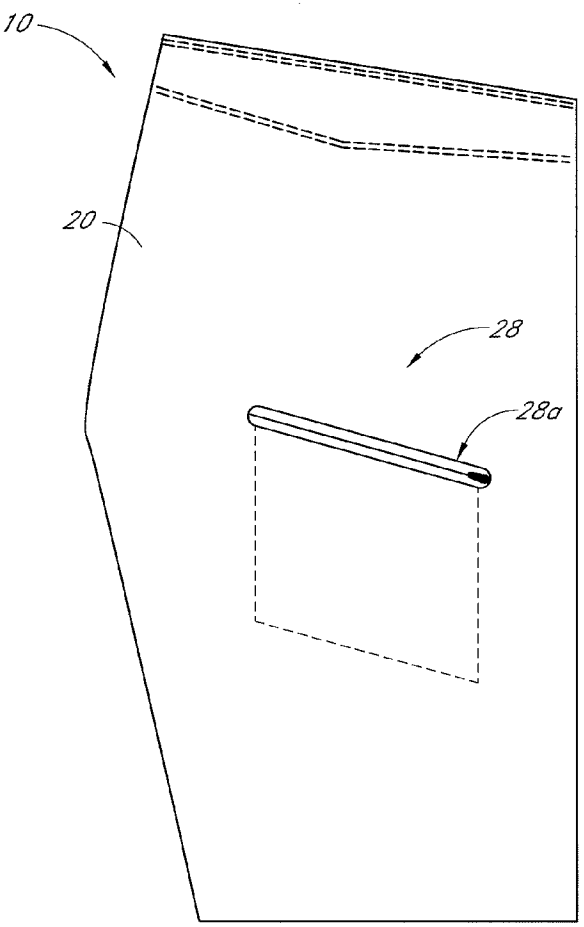

The athletic shorts 10 can comprise one or more pockets attached to one or more sides (e.g., the right side, left side, inside, and/or outside) of outer short 20 and/or inner short 30. FIG. 12A illustrates a right side view of an embodiment of a pocket attached to athletic shorts 10 of FIGS. 1 and 2. In the illustrated embodiment, outer short 20 comprises a pocket 28, accessible from an outer surface of short 20, and extending into the inner portion of short 20.

Pocket 28 can comprise a closing mechanism 28*a* to close its opening (e.g., a hook/loop fastener, zipper, snaps, buttons, etc.), and prevent loss of items placed within a pouch formed by pocket 28. In a preferred embodiment, pocket 28 comprises a waterproof zipper to prevent objects stored within pocket 28 from moisture. Pocket 28 can comprise a pouch of separate material attached (e.g., stitched, welded, adhered, bonded, etc.) to short 20 around the perimeter of the opening of the pouch formed by pocket 28, and/or attached around the perimeter of the pouch itself (e.g., FIG. 12B). Pocket 28 can comprise the same or different material relative to outer short 20 and/or inner short 30. In a preferred embodiment, pocket 28 comprises a waterproof material to protect objects placed within pocket 28 from moisture. A loop 28*b* can be attached to the interior of pocket 28, to secure items (e.g., keys, a surfboard comb, etc.) therewithin (FIG. 12C).

FIGS. 13A-13B show front views of embodiments of the aforementioned fly portion 27 of FIGS. 1 and 2. FIG. 14A shows a close-up front view of an embodiment of the fly portion 27 of FIGS. 13A-13B, with the fly shown in an open position. FIG. 14B shows a close-up rear view of an embodiment of the fly portion 27 of FIG. 14A, in a closed position.

Although embodiments of these inventions have been disclosed in the context of certain examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions.

What is claimed is:

1. A wearable garment comprising:

an outer short comprising a waist portion forming a waist opening, the outer short extending downwardly from the waist portion to a crotch portion in a longitudinal direction, and a pair of leg portions extending downwardly from the crotch portion along an inseam, each leg portion forming a leg opening;

an inner compression short configured to closely conform to a wearer's body, the inner short configured to fit within and be worn in combination with the outer short; and a first and second suspension element attached to the outer short to suspend the outer short from the inner short, the first and second suspension elements positioned bilaterally symmetrically about the anterior-posterior midline, and within the posterior one half of the outer short, the suspension elements configured to allow the outer short and the inner short to move relative to each other, wherein at least one of the first and second suspension elements comprises a strap comprising a pair of opposing ends, respectively attached to first and second portions of the outer short spaced from each other to form a loop, the strap comprising first and second attachment mechanisms vertically spaced relative to each other at two respective positions on the strap;

further comprising a third attachment mechanism configured on a portion of the inner short, the third attachment mechanism configured to attach to the first or second attachment mechanism.

2. The wearable garment of claim 1, wherein the first and second portions of the outer short, to which the pair of opposing ends are respectively attached, are vertically spaced from one another in the longitudinal direction.

3. The wearable garment of claim 2, wherein the opposing ends comprise a first opposing end attached to an upper portion of the waist portion, and a second opposing end attached to a lower portion of the waist portion.

4. The wearable garment of claim 1, wherein the first, second, and third attachment mechanisms are configured such that a location of attachment between the first or second attachment mechanism and the third attachment mechanism is substantially fixed relative to the strap.

5. The wearable garment of claim 1, wherein the suspension elements are configured to allow the outer short and the inner short to move relative to each other in two or more of a circumferential, radial, horizontal or vertical direction.

6. The wearable garment of claim 5, wherein at least a portion of at least one of the inner short and the outer short comprises a stretchable material to allow the outer short and the inner short to move relative to each other in at least one of the two or more of a circumferential, radial, horizontal or vertical direction.

7. The wearable garment of claim 1, wherein the first and second suspension elements are configured to provide a directional bias between the inner and outer shorts.

8. A wearable garment comprising:

an inner compression short comprising an inner short waistband forming a waist opening, the inner short extending downwardly from the waist portion to a crotch portion in a longitudinal direction, and a pair of leg portions extending downwardly from the crotch portion along an inseam, each leg portion forming a leg opening, the inner short configured to tightly fit around a wearer's body;

an outer short configured to receive and be worn in combination with the inner short, the outer short comprising an outer short waistband; and at least one suspension system configured to attach the inner short to the outer short and to suspend the outer short from the inner short, the suspension system comprising a strap comprising a pair of opposing ends respectively permanently attached to first and second portions of one of the inner short or the outer short to form a loop, the first and second portions being spaced from one another; and a first attachment mechanism configured on the other of the inner short or the outer short, the first attachment mechanism configured to attach the other of the inner short or the outer short to a corresponding second attachment mechanism configured on a first portion of the strap;

wherein the suspension system is configured to allow the outer short and the inner short to move relative to each other in one or more of a circumferential, radial, horizontal or vertical direction.

9. The wearable garment of claim 8, wherein the first attachment mechanism comprises one of a button or a button hole, and the second mechanism comprises the other of the button or the button hole.

10. The wearable garment of claim 8, wherein the opposing ends comprise a first opposing end attached to an upper portion of the waist portion, and a second opposing end attached to a lower portion of the waist portion.

11. The wearable garment of claim 8, further comprising a third attachment mechanism configured on a second portion of the strap, wherein the first attachment mechanism is configured to attach to the second or third attachment mechanism.

12. The wearable garment of claim 11, wherein the second and third attachment mechanisms are vertically spaced with respect to each other on the respective first and second portions of the strap.

13. The wearable garment of claim 8 wherein at least a portion of at least one of the inner short and the outer short comprises a stretchable material to allow the outer short and the inner short to move relative to each other in the one or more of a circumferential, radial, horizontal or vertical direction.

14. The wearable garment of claim 8, wherein the suspension system is configured to provide a directional bias between the inner and outer shorts.

15. The wearable garment of claim 8, wherein the first and second attachment mechanisms are configured such that a location of attachment is substantially fixed relative to the strap.

16. The wearable garment of claim 8, wherein the first and second portions, to which the pair of opposing ends are respectively attached, are vertically spaced from one another in the longitudinal direction.

17. A wearable garment comprising:

an inner compression short comprising an inner short waistband forming a waist opening, the inner short extending downwardly from the waist portion to a crotch portion in a longitudinal direction, and a pair of leg portions extending downwardly from the crotch portion along an inseam, each leg portion forming a leg opening, the inner short configured to tightly fit around a wearer's body;

an outer short configured to receive and be worn in combination with the inner short, the outer short comprising an outer short waistband; and at least one suspension system configured to attach the inner short to the outer short and to suspend the outer short from the inner short, the suspension system comprising a strap comprising a pair of opposing ends respectively directly attached to first and second portions of one of the inner short or the outer short to form a loop, the first and second portions being spaced from one another; and a first attachment mechanism configured on the other of the inner short or the outer short, the first attachment mechanism configured to attach the other of the inner short or the outer short to a corresponding second attachment mechanism configured on a first portion of the strap;

wherein the suspension system is configured to allow the outer short and the inner short to move relative to each other in one or more of a circumferential, radial, horizontal or vertical direction.

18. The wearable garment of claim 17, wherein the first attachment mechanism comprises one of a button or a button hole, and the second mechanism comprises the other of the button or the button hole.

19. The wearable garment of claim 17, wherein the opposing ends comprise a first opposing end attached to an upper portion of the waist portion, and a second opposing end attached to a lower portion of the waist portion.

20. The wearable garment of claim 17, further comprising a third attachment mechanism configured on a second portion of the strap, wherein the first attachment mechanism is configured to attach to the second or third attachment mechanism.

21. The wearable garment of claim 20, wherein the second and third attachment mechanisms are vertically spaced with respect to each other on the respective first and second portions of the strap.

22. The wearable garment of claim 17, wherein at least a portion of at least one of the inner short and the outer short comprises a stretchable material to allow the outer short and the inner short to move relative to each other in the one or more of a circumferential, radial, horizontal or vertical direction.

23. The wearable garment of claim 17, wherein the suspension system is configured to provide a directional bias between the inner and outer shorts.

24. The wearable garment of claim 17, wherein the first and second attachment mechanisms are configured such that a location of attachment is substantially fixed relative to the strap.

25. The wearable garment of claim 17, wherein the first and second portions, to which the pair of opposing ends are respectively attached, are vertically spaced from one another in the longitudinal direction.

* * * * *